US006975188B2

(12) United States Patent
Rawnick et al.

(10) Patent No.: US 6,975,188 B2
(45) **Date of Patent: *Dec. 13, 2005**

(54) VARIABLE WAVEGUIDE

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 8 days.

This patent is subject to a terminal disclaimer.

(21) Appl. No.: 10/632,632

(22) Filed: Aug. 1, 2003

(65) Prior Publication Data

US 2005/0024167 A1 Feb. 3, 2005

(51) Int. Cl.[7] ..... H01P 1/23; H01P 3/12
(52) U.S. Cl. ..... 333/209; 333/211; 333/81 B
(58) Field of Search ..... 333/209, 208, 333/211, 81 R, 81 B

(56) References Cited

U.S. PATENT DOCUMENTS

| | | | | |
|---|---|---|---|---|
| 3,701,058 A | | 10/1972 | Smith | 333/159 |
| 4,604,592 A | * | 8/1986 | Pinson | 333/24.1 |
| 5,792,236 A | | 8/1998 | Taylor et al. | |
| 6,512,496 B2 | | 1/2003 | Alexeff et al. | 343/915 |
| 6,743,371 B2 | * | 6/2004 | John et al. | 252/62.52 |
| 2003/0160724 A1 | | 8/2003 | Alexeff et al. | 343/701 |
| 2004/0130497 A1 | | 7/2004 | Alexeff et al. | 343/725 |

OTHER PUBLICATIONS

U.S. Appl. No. 10/330,756, filed Dec. 27, 2002, Rawnick et al.
U.S. Appl. No. 10/626,090, filed Jul. 24, 2003, Brown et al.
U.S. Appl. No. 10/625,977, filed Jul. 24, 2003, Rawnick et al.
U.S. Appl. No. 10/614,149, filed Jul. 7, 2003, Brown et al.
U.S. Appl. No. 10/620,483, filed Jul. 16, 2003, Brown et al.
U.S. Appl. No. 10/640,237, filed Aug. 13, 2003, Rawnick et al.
U.S. Appl. No. 10/648,913, filed Aug. 27, 2003, Brown et al.
U.S. Appl. No. 10/414,695, filed Apr. 16, 2003, Rawnick et al.
U.S. Appl. No. 10/460,947, filed Jun. 13, 2003, Rawnick et al.
U.S. Appl. No. 10/421,305, filed Apr. 23, 2003, Rawnick et al.
U.S. Appl. No. 10/648,887, filed Aug. 27, 2003, Rawnick et al.
U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.

(Continued)

*Primary Examiner*—Stephen E. Jones
(74) *Attorney, Agent, or Firm*—Sacco & Associates, PA

(57) ABSTRACT

A variable waveguide system (100). The variable waveguide system (100) includes a waveguide (102), a dielectric structure (116) including at least one cavity disposed within the waveguide, and a conductive fluid (126). The cavity is filled with the conductive fluid (126) in a first operational state, and the cavity is purged of the conductive fluid (126) in a second operational state. A fluid control system (150) can be provided for transferring the conductive fluid (126) in and out of the cavity in response to a control signal (174). The waveguide (102) can have a first cutoff frequency in the first operational state and a second cutoff frequency in the second operational state. Further, the waveguide (102) can have a first electrical length in the first operational state and a second electrical length in the second operational state.

18 Claims, 3 Drawing Sheets

U.S. PATENT DOCUMENTS

U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.
U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/635,582, filed Aug. 6, 2003, Rawnick et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/4421,352, filed Apr. 23, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.

* cited by examiner

VARIABLE WAVEGUIDE

BACKGROUND OF THE INVENTION

1. Statement of the Technical Field

The inventive arrangements relate generally to methods and apparatus for providing increased design flexibility for RF circuits, and more particularly to a variably tunable waveguide.

2. Description of the Related Art

A waveguide is a transmission line structure that is commonly used for microwave signals. A waveguide typically consists of a hollow tube made of an electrically conductive material, for example copper, brass, steel, etc., and can be provided in a variety of shapes. Most often waveguides have a rectangular or circular cross section.

In operation, waveguides propagate modes above a certain cutoff frequency ($f_c$). In a waveguide which has a rectangular cross section, the signal wavelength ($\lambda_c$) at the cutoff frequency is given by the equation $$\lambda_c = \frac{1}{\sqrt{\left(\frac{m}{2a}\right)^2 + \left(\frac{n}{2b}\right)^2}},$$

where m,n are mode numbers, a is a width of the wider side of the waveguide, and b is a width of the waveguide measured along the narrow side. The lowest frequency mode in a waveguide is the $TE_{10}$ mode. In this mode, the equation for the signal wavelength at the cutoff frequency reduces to $\lambda_c$=2a. Further, the relationship between $f_c$ and $\lambda_c$, is given by the equation $$f_c = \frac{v}{\lambda_c},$$

where v is the propagation velocity of a signal within the waveguide. Accordingly, the equation for the cutoff frequency becomes $$f_c = \frac{v}{2a} = \frac{c}{2a\sqrt{\mu_r \varepsilon_r}},$$

where $\mu_r$ is the relative permeability within the waveguide and $\epsilon_r$ is the relative permittivity within the waveguide. Below the cutoff frequency, the attenuation is given by $$\alpha = 54.6\frac{l}{\lambda^c}\sqrt{1-\left(\frac{f}{f_c}\right)^2},$$

where $\alpha$ is attenuation measured in decibels (dB), l is the length of the waveguide, and f is the frequency at which the attenuation is being calculated.

A waveguide typically has fixed dimensions, and the permittivity and permeability are usually constant. Hence, the cutoff frequency and attenuation characteristics of a waveguide usually are fixed, thus limiting the flexibility of waveguides for use in RF applications.

SUMMARY OF THE INVENTION

The present invention relates to a variable waveguide system. The variable waveguide system includes a waveguide, a dielectric structure including at least one cavity disposed within the waveguide, and a conductive fluid. The cavity is filled with the conductive fluid in a first operational state, and the cavity is purged of the conductive fluid in a second operational state. A fluid control system can be provided for transferring the conductive fluid in and out of the cavity in response to a control signal.

The waveguide can have a first cutoff frequency in the first operational state and a second cutoff frequency in the second operational state. Further, the waveguide can have a first electrical length in the first operational state and a second electrical length in the second operational state.

The dielectric structure can include a plurality of fluid conduits, each defining an elongated cavity, and arranged in a row to form an effective waveguide wall. For example, the plurality of fluid conduits can extend from a first wall of the waveguide to a second wall of the waveguide, wherein the second wall is spaced from the first wall. The conductive fluid which is contained in the plurality of fluid conduits in the first operational state can form an electrical connection with the first and second walls.

In one arrangement, the dielectric structure can be comprised of at least a first solid dielectric wall extending from a first conductive wall of the waveguide to a second conductive wall of the waveguide. A cavity can be defined between the first dielectric wall and at least one conductive wall of the waveguide. The dielectric structure further can include a second dielectric wall, wherein the cavity is defined between the first dielectric wall and the second dielectric wall.

The present invention also includes a method of controlling a waveguide. The method includes the step of providing a waveguide dimensioned for producing a first electrical characteristic for the waveguide. The method also includes the step of adding a conductive fluid to an internal portion of the waveguide to produce a second electrical characteristic for the waveguide in response to a control signal. The second electrical characteristic is different from the first electrical characteristic.

The method can further include the step of constraining the conductive fluid in a portion of the waveguide to modify a cutoff frequency of the waveguide and/or an electrical length of the waveguide. The conductive fluid can be constrained in a plurality of fluid conduits, each defining an elongated cavity, and arranged in a row to form an effective waveguide wall. An electrical connection can be formed between the conductive fluid and at least one conductive wall of the waveguide.

The conductive fluid also can be constrained using at least a first solid dielectric wall extending from a first conductive wall of the waveguide to a second conductive wall of the waveguide, wherein the second conductive wall is spaced from the first conductive wall. The conductive fluid can be constrained between the first dielectric wall and at least one conductive wall of the waveguide. In another arrangement, the method can include the step of constraining the conductive fluid between the first dielectric wall and a second dielectric wall.

DETAILED DESCRIPTION OF THE PREFERRED EMBODIMENTS

The present invention relates to a variable waveguide. The electrical characteristics of the waveguide can be adjusted by using a conductive fluid to effectively create, or extend, at least one waveguide wall, thereby changing the effective dimensions of the waveguide.

Figure 1:
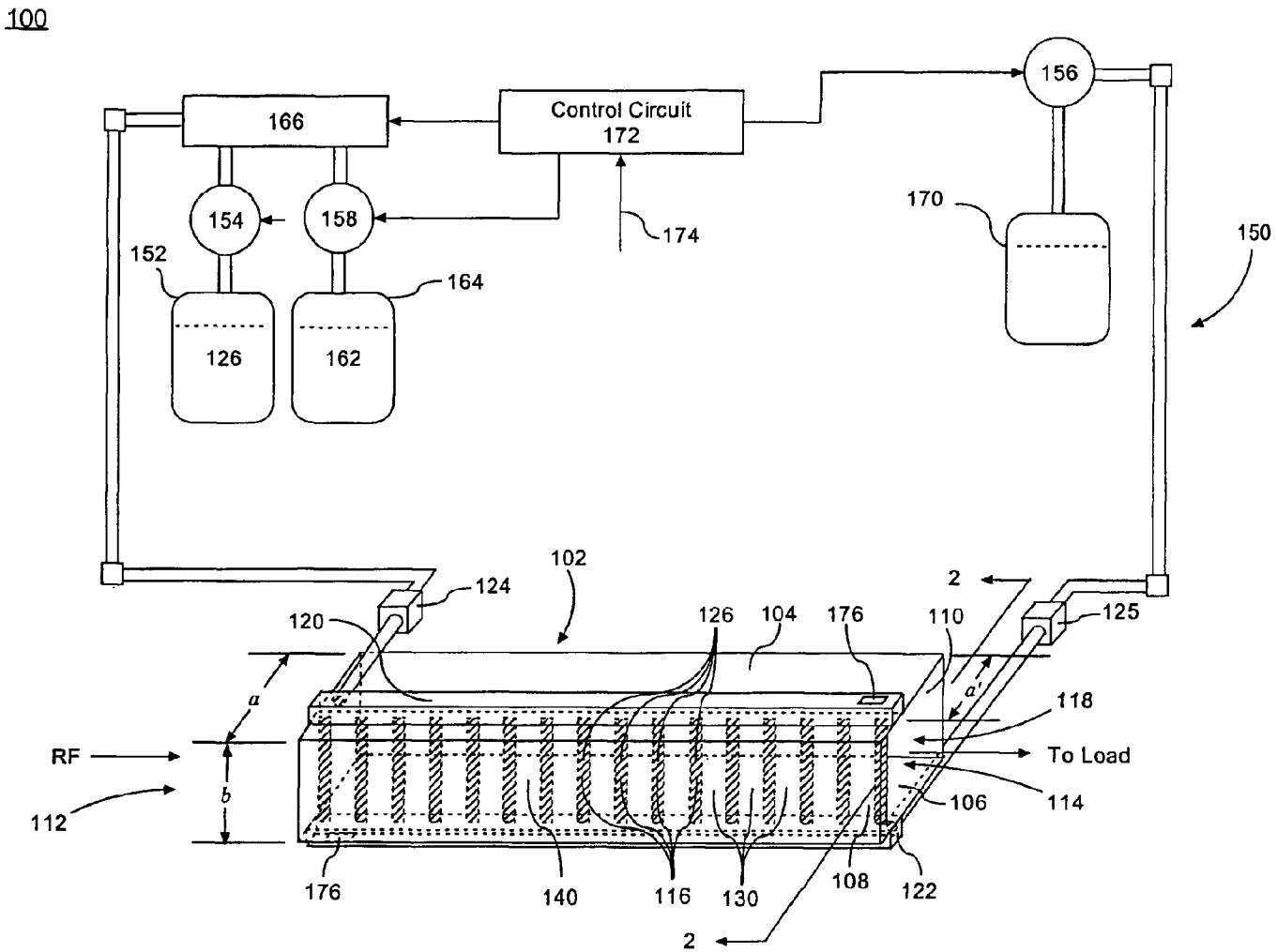
FIG. 1 is a conceptual diagram useful for understanding a variable waveguide in accordance with the present invention.
Figure 2:
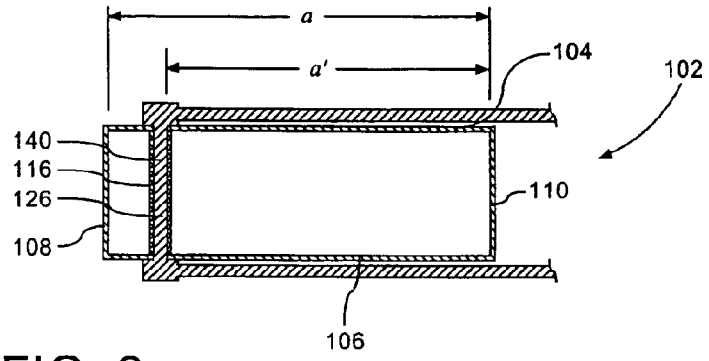
FIG. 2 is a cross-sectional view of the waveguide of FIG. 1, taken along line section line 2—2.

FIG. 1 is a conceptual diagram that is useful for understanding the variable waveguide of the present invention. In FIG. 1, a waveguide tuning apparatus 100 is presented which includes a waveguide 102. The waveguide 102 can be a tubular structure having at least one wall, an input opening 112 and an output opening 114. At this point it should be noted that the present invention is not limited to any particular waveguide structure. In particular, the present invention can be used with waveguides having any configuration or shape. In one arrangement, the waveguide can have a rectangular cross section. For example, the waveguide can have opposing waveguide walls 104, 106 having a width a and opposing waveguide walls 108, 110 having a width b, thereby defining a waveguide dielectric region 118 within the waveguide walls 104, 106, 108, 110. A cross-sectional view of the variable waveguide in FIG. 1, taken along line section 2—2, is shown in FIG. 2.

One or more fluid conduits 116 having cavities can extend from wall 104 to wall 106. The fluid conduits 116 can be any conduit that can contain a conductive fluid 126 so that electrical continuity can be provided between wall 104 and wall 106 at the location of the fluid conduit when the conductive fluid 126 is present. In particular, the fluid conduits 116 can be channels, tubes, elongated cavities, or any other type of dielectric cavity which extends from a first portion of the waveguide to a second portion of the waveguide. For example, the fluid conduits 116 can extend between portions of two or more waveguide walls. The fluid conduits 116 can be glass, plastic, ceramic or any other dielectric material which can contain the conductive fluid 126 within the fluid conduits 116.

In one arrangement, where a dielectric material is disposed between the walls 104, 106, the fluid conduits 116 can be bores or vias that extend from wall 104, through the dielectric to wall 106. In another arrangement, the bores can extend through the walls 104, 106 as well. Moreover, the fluid conduits 116 can extend from, or to, any of the waveguide walls, and the fluid conduits 116 can be disposed to create differing waveguide structures. Still, there are a myriad of conduits and conduit configurations that can be used, all of which are intended to be included within the scope of the invention.

In a first operational state, the conductive fluid 126 can be injected into the fluid conduits 116 to create a plurality of conductive regions which create an effective waveguide wall (effective wall) 140 extending between the walls 104, 106 and located in a region defined by the plurality of fluid conduits 116. For example, the effective wall 140 can be parallel to, and located inward from, walls 108, 110. Accordingly, the waveguide can be defined to be bounded by walls 104, 106, 110 and the effective waveguide wall. In consequence, the effective width a of the waveguide walls 104, 106 is reduced to a'.

As noted, in the $TE_{10}$ mode the equation for signal wavelength ($\lambda_c$) at the cutoff frequency ($f_c$) reduces to $\lambda_c$=2a. Hence, the reduction in the effective width of waveguide walls 104, 106 reduces the signal wavelength at the cutoff frequency, and thus increases $f_c$. Also as noted, the attenuation of the waveguide below $f_c$ is given by $$\alpha = 54.6\frac{l}{\lambda_c}\sqrt{1-\left(\frac{f}{f_c}\right)^2}.$$

The increase in $f_c$ and the decrease in $\lambda_c$ caused by the effective narrowing of the walls 104, 106 each contribute to an increase in waveguide attenuation below $f_c$. Accordingly, the conductive fluid 126 can be injected into the fluid conduits 116 to change $f_c$, $\lambda_c$, or vary waveguide attenuation below $f_c$.

The skilled artisan will appreciate that power currents in the waveguide are propagated from the input opening 112 towards the output opening 114 via walls 104, 106. In particular, the power currents are generated from electric fields which are formed between walls 104,106. Notably, power currents do not typically propagate from the input opening 112 towards the output opening 114 on the narrower waveguide walls, which in this case are wall 108 and the effective wall 140 (when fluid conduits 116 are filled with conductive fluid 126), because in general electric fields do not form between these walls. Accordingly, gaps 130 in the effective wall 140 between fluid conduits 116 do not adversely affect waveguide performance, provided these gaps were smaller than approximately 1/10 wavelength.

A third waveguide also can be defined which is bounded by walls 104, 106, 108 and the effective wall 140. In the case that the width (a−a') between wall 108 and the effective wall 140 is greater than width b, the third waveguide will operate as previously discussed, except that $\lambda_c$=2(a−a'). In the case that width (a−a') is less than width b, the signal wavelength at the cutoff frequency for the third waveguide then becomes $\lambda_c$=2b. In such a configuration the effective wall 140 will be one of the walls having the greatest width. Gaps 130 could adversely affect propagation for power currents in such an arrangement and may cause the propagating signal to radiate through the gaps. The amount of radiation would be dependent on the electrical size of the gaps. If the electrical size of the gaps is relatively large with respect to the operational frequency, the flow of power through the third waveguide could be disrupted.

In a second operational state, the conductive fluid 126 can be purged from the fluid conduits 116, thereby removing the effective wall 140. For example, a vacuum or positive pressure can be used to purge the conductive fluid 126 from the fluid conduits 116. In one arrangement, the conductive fluid 126 can be replaced with a fluid dielectric 162 or a gas. The fluid dielectric or gas can be any fluid or gas which can be injected in the fluid conduits 116 to remove the conductive fluid 126 from the fluid conduits.

A typical fluid dielectric can be, for example, an oil such as Vacuum Pump Oil MSDS-12602. a solvent, such as formamide, water, etc. Typical gases can include air, nitrogen, helium, and so on. Importantly, the invention is not limited to any particular fluid dielectric 162 or gas. Those skilled in the art will recognize that the examples of fluid dielectric or gas as disclosed herein are merely by way of example and are not intended to limit in any way the scope of the invention.

Figure 3A:
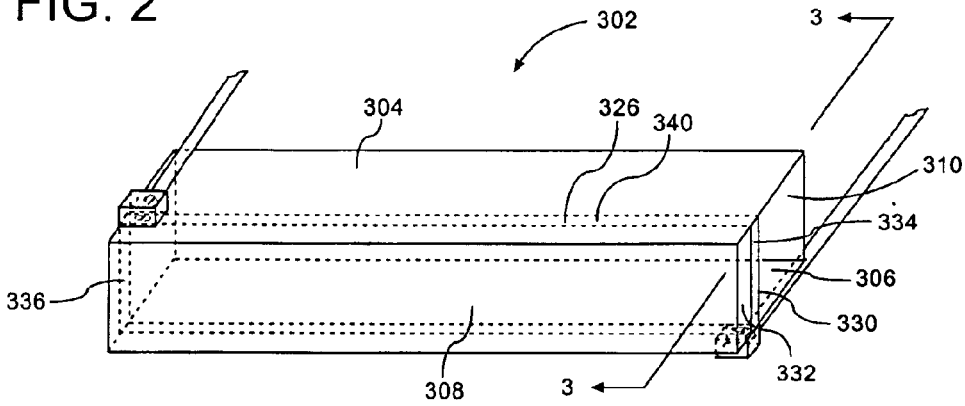
FIG. 3A is a conceptual diagram of an alternate embodiment of the waveguide.
Figure 3B:
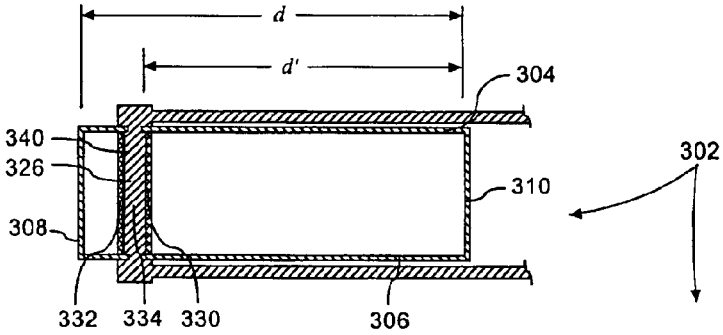
FIG. 3B is a cross-sectional view of the waveguide of FIG. 3A, taken along line section line 3—3.

Referring to FIG. 3A, an alternative embodiment for a variable waveguide 302 is shown wherein dielectric walls define a cavity 340 within waveguide 302. A cross-sectional view taken along section lines 3—3 is shown in FIG. 3B. The cavity 340 is bounded by waveguide walls 304, 306 and dielectric walls 330, 332, 334, 336. The dielectric walls can be glass, plastic, or any other dielectric material which can prevent leakage of a conductive fluid 326 from the cavity 340. Accordingly, the dielectric walls 330, 332, 334, 336 will maintain the conductive fluid 326 within the cavity 340, while having an insignificant impact on waveguide performance when the conductive fluid 326 is not present in the cavity 340.

Figure 3C:
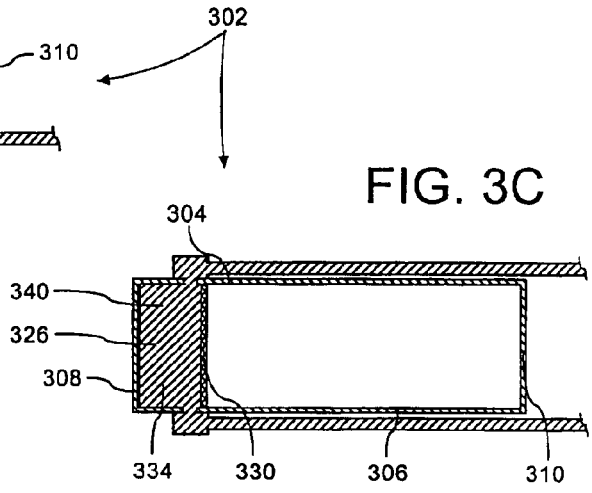
FIG. 3C is a cross-sectional view of another arrangement of the waveguide of FIG. 3A, taken along line section line 3—3.

The conductive fluid 326 can be injected into the cavity 340 during the first operational state to define an effective wall 140 in the cavity region which reduces the effective width of walls 304, 306 from d to d', as measured from wall 310. Accordingly, $\lambda_c$ is decreased and $f_c$ is increased which, as noted, increases attenuation below $f_c$. Again, a third waveguide is defined which is bounded by walls 304, 306, 308 and the effective wall 140. In this arrangement, however, the effective wall 140 is continuous, and thus can be used to propagate power currents. Alternatively, cavity 340 can be defined by waveguide walls 304, 306, 308 and dielectric walls 330, 334, 336 (without the use of dielectric wall 332), as shown if FIG. 3C. Accordingly, the cavity 340 can be completely filled with conductive fluid 326 so that a third waveguide is not created when the conductive fluid 326 is present.

Fluid Control System

Referring once again to FIG. 1, it can be seen that the invention preferably includes a fluid control system 150 for selectively controlling the presence and/or removal of the conductive fluid 126 from the fluid conduits 116. The fluid control system 150 also can be used for selectively controlling the presence and/or removal of the conductive fluid 126 from the cavity 134 of FIG. 3A. However, for convenience, the operation of the fluid control system shall be described relative to FIGS. 1 and 2. The fluid control system can comprise any suitable arrangement: of pumps, valves and/or conduits that are operable for effectively injecting and/or removing the conductive fluid 126. A wide variety of such fluid control systems may be implemented by those skilled in the art. For example, in one embodiment, the fluid control system can include a reservoir 152 for the conductive fluid 126 and a pump 154 for injecting the conductive fluid 126 into the fluid conduits 116.

The conductive fluid 126 can be injected into the fluid conduits 116 (or cavity 134 of FIG. 3A) by means of a suitable fluid transfer conduit 120. A second fluid transfer conduit 122 can also be provided for permitting the conductive fluid 126 to be purged from the fluid conduits 116 so that the conductive fluid 126 does not provide an effective wall 140. Further, fluid valves 124, 125 can be provided to control fluid transfer to conduits 120, 122 and the fluid conduits 116. The fluid valves 124, 125 can be closed to contain the conductive fluid 126 within the fluid conduits 116 during the first operational state, and opened when the conductive fluid 126 is purged from the fluid conduits 116. In one embodiment the fluid valves 124, 125 can be mini-electromechanical or micro-electromechanical systems (MEMS) valves, which are known to the skilled artisan.

One or more sensors 176 can be provided to verify the presence of the conductive fluid in the fluid conduits. For example, resistance sensors can be provided in the fluid transfer conduits 120, 122 which detect whether a conductive fluid is present in the fluid transfer conduits 120, 122. The resistance sensors can detect the presence of the conductive fluid by determining whether a fluid with low resistance is present in the fluid transfer conduits 120, 122. Sensor readings which verify that the conductive fluid is present in the fluid transfer conduits 120, 122 can be indicative of conductive fluid being present in the fluid conduits 116. Alternatively, sensors can be provided for individual fluid conduits 116.

When it is desired to purge the conductive fluid 126 from the fluid conduits 116, a pump 156 can be used to draw the conductive fluid 126 from the fluid conduits 116 into a recovery reservoir 170. Alternatively, in order to ensure a more complete removal of all conductive fluid from the fluid conduits 116, one or more pumps 158 can be used to inject a dielectric solvent 162 into the fluid conduits 116. The dielectric solvent 162 can be stored in a second reservoir 164 and can be useful for ensuring that the conductive fluid 126 is completely and efficiently flushed from the fluid conduits 116. A control valve 166 can be used to selectively control the flow of conductive fluid 126 and dielectric solvent 162 into the fluid conduits 116. The sensors 176 can detect whether the conductive fluid has been completely purged from the fluid conduits.

A mixture of the conductive fluid 126 and any excess dielectric solvent 162 that has been purged from the fluid conduits 116 can be collected in the recovery reservoir 170. For convenience, additional fluid processing, not shown, can also be provided for separating dielectric solvent from the conductive fluid contained in the recovery reservoir for subsequent reuse. However, the additional fluid processing is a matter of convenience and not essential to the operation of the invention.

A control circuit 172 can be configured for controlling the operation of the fluid control system 150 in response to an analog or digital fluid control signal 174. For example, the control circuit 172 can control the operation of the various valves 120, 122, 166, and pumps 154, 156, 158 necessary to selectively control the presence and removal of the conductive fluid 126 and the dielectric solvent 162 from the fluid conduits 116. It should be understood that the fluid control system 150 is merely one possible implementation among many that could be used to inject and purge conductive fluid from the fluid conduits 116 and the invention is not intended to be limited to any particular type of fluid control system. All that is required of the fluid control system is the ability to effectively control the presence and removal of the conductive fluid 126 from the fluid conduits 116.

Composition of Conductive Fluid

The conductive fluid used in the invention can be selected from the group consisting of a metal or metal alloy that is liquid at room temperature. The most common example of such a metal would be mercury. However, other electrically conductive, liquid metal alloy alternatives to mercury are commercially available, including alloys based on gallium and indium alloyed with tin, copper, and zinc or bismuth. These alloys, which are electrically conductive and non-toxic, are available from NewMerc, Ltd. of Blacksburg, Va. Other conductive fluids include a variety of solvent-electrolyte mixtures that are well known in the art. As for conductivity, there are several options. Both a conductive "plate" and a very high (relatively to the material adjacent to it) dielectric interface will cause an incident wave to reflect but only a conductive fluid will allow the necessary ground currents to flow without undue attenuation. Using a perfect conductor, all energy is reflected. Using a non-perfect conductor, some energy will be dissipated as heat in the conductive material. Conductivities greater than 20 would be desirable, although effective systems could be employed utilizing conductivities as low as 1 or 2.

Multiple Effective Walls

Figure 4:
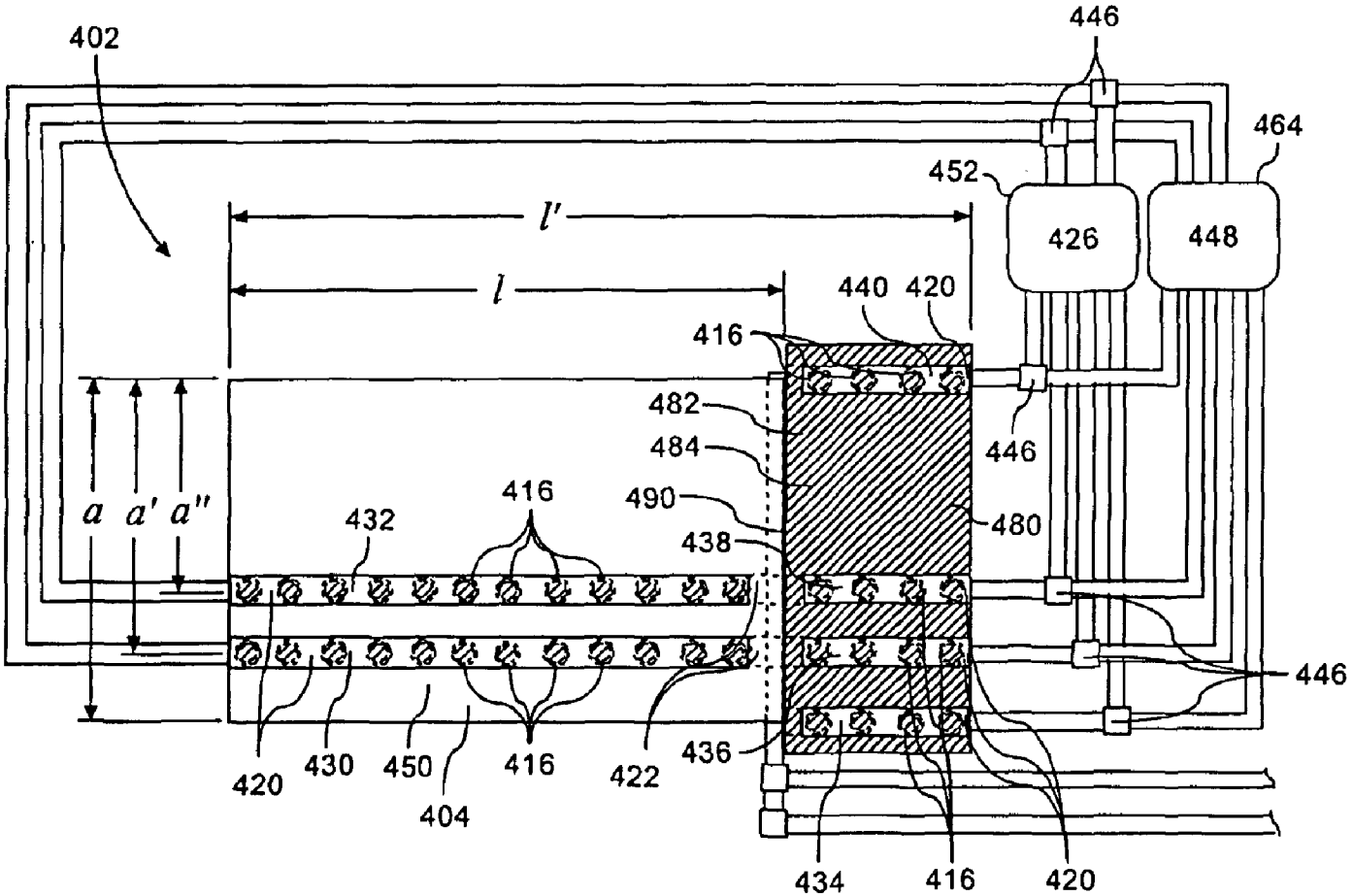
FIG. 4 is a top view of another alternate embodiment of the waveguide.

In the most basic form, the invention can be implemented using a single cavity or a single row of fluid conduits as illustrated in FIGS. 1–3C. However, those skilled in the art will readily appreciate that the invention is not so limited. Referring to FIG. 4, an exemplary waveguide 402 comprising a plurality of rows 430, 432, 434, 436, 438, 440 of fluid conduits 416 is shown. The rows 430, 432, 434, 436, 438, 440 of fluid conduits 416 can be used to adjust the performance characteristics of the waveguide 402. Notably, any number of rows of fluid conduits 416 can be provided.

The rows 430, 432, 434, 436, 438, 440 can be disposed to provide effective walls in various regions of the waveguide 402. For example, rows 430, 432 can provide varying width adjustment for the waveguide 402, which can be useful for changing the cutoff frequency of the waveguide. In particular, conductive fluid 426 can be injected into the fluid conduits 416 of row 430 to reduce the effective width of the waveguide 402 from a to a'. Alternatively, conductive fluid 426 can be injected into the fluid conduits 416 of row 432 to reduce the effective width of the waveguide 402 to a".

Further, rows 434, 436, 438, 440 of fluid conduits 416 can provide length adjustment for the waveguide 402, which can be useful for changing the attenuation of the waveguide 402 below the waveguide cutoff frequency. For example, rows 434, 436, 438, 440 of fluid conduits 416 can be used to extend the length of the waveguide 402 from l to l'.

In one arrangement, rows 434, 436, 438, 440 of fluid conduits 416 can be provided in a dielectric structure 480 which has a low permittivity and a low permeability. Accordingly, the dielectric structure 480 will have minimum impact on waveguide performance when rows 434, 436, 438, 440 of fluid conduits 416 are not filled with conductive fluid 426. The dielectric structure 480 can have a width at least as wide as waveguide 402 width a, a thickness at least as thick as waveguide 402, and a length at least as long as (l–l'). Further, the dielectric structure 480 can be coupled to a tubular waveguide body 450 at intersection 490.

An upper planar conductor 482 can be deposited on a top surface 484 of the dielectric structure 480 and a lower planar conductor (not shown) can be deposited on a bottom surface (not shown) of the dielectric structure 480. In a preferred arrangement, the upper planar conductor 482 is electrically continuous with an upper waveguide wall 404 at the intersection 490, thereby extending the length of there upper waveguide wall 404. Likewise, it is preferred that the lower planar conductor is electrically continuous with a lower waveguide wall (not shown) at the intersection 490, thereby extending the length of lower waveguide wall.

Accordingly, when conductive fluid 426 is injected into fluid conduits 416 in row 440 and conductive fluid 426 is injected into fluid conduits 416 in at least one of the rows 434, 436, 438, the effective length of the waveguide 402 is extended from l to l'. For example, the conductive fluid 426 can be injected into the fluid conduits 416 of rows 438, 440 simultaneously with fluid conduits 416 of row 432. In this arrangement the effective width of the waveguide 402 is a" and the effective length of the waveguide is l'. Likewise, conductive fluid 426 can be injected into the fluid conduits 416 in rows 436, 440 while conductive fluid is present in fluid conduits 416 of row 430. In this arrangement the effective width is a' and the effective length is l'. Conductive fluid 426 can be injected into the fluid conduits 416 of rows 434, 440 when the fluid conduits 416 of rows 430, 432 remain purged or unfilled. In this arrangement the effective width of the waveguide 402 is a while the effective length is extended to l'.

At this point it should be noted that the arrangement shown in FIG. 4 is for exemplary purposes and a variety of arrangements can be provided wherein a conductive fluid can be used to change the effective dimensions of a waveguide, all of which are within the scope of the present invention. For example, in lieu of rows 430, 432, 434, 436, 438, 440, the present invention can include cavities formed of dielectric walls which contain the conductive fluid 126 in the regions defined by rows 432, 434, 434, 436, 438, 440. Further, a conductive fluid can be used in lieu of the upper planar conductor 482 and the lower planar conductor to extend the upper and lower waveguide walls.

As noted, the fluid control system can comprise any suitable arrangement of pumps, valves and conduits that are operable for effectively injecting and removing conductive fluid 426, or any other fluid or gas, from the fluid conduits 416. For example, the fluid control system can include reservoirs 452, 464 and control valves 466 to inject the conductive fluid 426 or fluid dielectric 448 in the appropriate fluid conduit. Suitable fluid pumps (not shown) and fluid transfer conduits 420 also can be provided in the fluid control system to facilitate injection of conductive fluid 426 into fluid conduits 416. Further, fluid transfer conduits 422 and an appropriate pump (not shown) can be provided to remove the conductive fluid 426 or fluid dielectric 448 from the fluid conduits 416.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A variable waveguide system, comprising:

a waveguide;

a dielectric structure at least partially defining at least one cavity disposed within said waveguide; and a conductive fluid, wherein said waveguide has a first operational state in which said cavity is filled with said conductive fluid and a second operational state in which said cavity is purged of said conductive fluid.

2. The variable waveguide system according to claim 1 wherein said waveguide has a first cutoff frequency in said first operational state and a second cutoff frequency different from said first cutoff frequency in said second operational state.

3. The variable waveguide system according to claim 1 wherein said waveguide has a first electrical length in said first operational state and a second electrical length different from said first electrical length in said second operational state.

4. The variable waveguide system according to claim 1 wherein said dielectric structure is comprised of a plurality of fluid conduits, each defining an elongated cavity, and arranged in a row to form an effective waveguide wall.

5. The variable waveguide system according to claim 4 wherein said plurality of fluid conduits extend from a first wall of said waveguide to an second wall of said waveguide, said second wall being spaced from said first wall.

6. The variable waveguide system according to claim 5 wherein said conductive fluid contained in said plurality of fluid conduits in said first state forms an electrical connection with said first and second walls.

7. The variable waveguide system according to claim 1 wherein said dielectric structure is comprised of at least a first solid dielectric wall extending from a first conductive wall of said waveguide to a second conductive wall of said waveguide, said second conductive wall being spaced from said first conductive wall.

8. The variable waveguide system according to claim 7 wherein said cavity is defined between said first dielectric wall and at least one conductive wall of said waveguide.

9. The variable waveguide system according to claim 7 wherein said dielectric structure is further comprised of a second dielectric wall, and said cavity is defined between said first and second dielectric walls.

10. A variable waveguide system according to claim 1 further comprising a fluid control system for transferring said conductive fluid into and out of said at least one cavity responsive to a control signal.

11. A method for controlling a waveguide, comprising the steps of:

providing a waveguide dimensioned for producing a first electrical characteristic for said waveguide;

providing at least one internal cavity disposed within said waveguide at least partially formed from a dielectric structure and purged of a conductive fluid; and responsive to a control signal, filling said at least one internal cavity of said waveguide with said conductive fluid to produce a second electrical characteristic for said waveguide, said second electrical characteristic being different from said first electrical characteristic.

12. The method according to claim 11 further comprising the step of constraining said conductive fluid in a portion of said waveguide to modify a cutoff frequency of said waveguide.

13. The method according to claim 11 further comprising the step of constraining said conductive fluid in a portion of said waveguide to modify an electrical length of said waveguide.

14. The method according to claim 11 further comprising the step of constraining said conductive fluid in a plurality of fluid conduits, each defining an elongated cavity, and arranged in a row to form an effective waveguide wall.

15. The method according to claim 14 further comprising the step of forming an electrical connection between said conductive fluid and at least one conductive wall of said waveguide.

16. The method according to claim 11 further comprising the step of constraining said conductive fluid using at least a first solid dielectric wall extending from a first conductive wall of said waveguide to a second conductive wall of said waveguide, said second conductive wall being spaced from said first conductive wall.

17. The method according to claim 16 further comprising the step of constraining said conductive fluid between said first dielectric wall and at least one conductive wall of said waveguide.

18. The method according to claim 17 further comprising the step of constraining said conductive fluid between said first dielectric wall and a second dielectric wall.

* * * * *